US009896839B2

(12) United States Patent
Hilliaho

(10) Patent No.: US 9,896,839 B2
(45) Date of Patent: Feb. 20, 2018

(54) LOCKING ARRANGEMENT AND PANEL SYSTEM

(71) Applicant: LUMON INVEST OY, Kouvola (FI)

(72) Inventor: Esa Hilliaho, Valkeala (FI)

(73) Assignee: LUMON INVEST OY, Kouvola (FI)

( * ) Notice: Subject to any disclaimer, the term of this patent is extended or adjusted under 35 U.S.C. 154(b) by 0 days.

(21) Appl. No.: 15/348,499

(22) Filed: Nov. 10, 2016

(65) Prior Publication Data

US 2017/0130453 A1 May 11, 2017

(30) Foreign Application Priority Data

Nov. 10, 2015 (FI) ..... 20155828

(51) Int. Cl.
*E04B 2/82* (2006.01)
*E06B 3/92* (2006.01)
(Continued)

(52) U.S. Cl.
CPC ..... *E04B 2/827* (2013.01); *E04B 1/34321* (2013.01); *E04B 2/7401* (2013.01);
(Continued)

(58) Field of Classification Search
CPC .... E04B 2/827; E04B 2/7401; E04B 1/34321; E05D 15/0604; E06B 3/924; E06B 3/5072
See application file for complete search history.

(56) References Cited

U.S. PATENT DOCUMENTS 2,574,312 A * 11/1951 Altube ..... E05D 15/0604 160/206
3,027,606 A * 4/1962 Nicklas ..... E05D 15/264 16/104
(Continued)

FOREIGN PATENT DOCUMENTS

EP 1085156 A1 3/2001
ES 2 400 560 A2 4/2013
(Continued)

OTHER PUBLICATIONS

Mar. 30, 2017 Search Report issued in European Patent Application No. 16397531.1.

*Primary Examiner* — Paola Agudelo
(74) *Attorney, Agent, or Firm* — Oliff PLC

(57) ABSTRACT

The panel system includes lower and upper guides and at least one panel located between and connected to them, to move the panel on the lower guide. The panel system includes a hinge element fixed to the panel and allows the panel to be opened by turning essentially around a rotation axis. The panel system further includes at least two locking housings positioned successively on the upper guide. The locking housings include two opposite locking recesses, defining a circle with radius R3 and between which remains a passage with width P2. The hinge element can travel from one locking housing to another through the passage. The distance between the locking housings is distance P1, configured to be less than two times radius R3. The hinge element may include two locking cams and in addition a guiding edge remaining between them. The panel system locking arrangement includes the hinge element.

13 Claims, 5 Drawing Sheets

(51) Int. Cl.

| | |
|---|---|
| ***E04B 1/343*** | (2006.01) |
| ***E04B 2/74*** | (2006.01) |
| ***E05D 15/06*** | (2006.01) |
| *E06B 3/50* | (2006.01) |

(52) U.S. Cl.
CPC ..... *E05D 15/0604* (2013.01); *E06B 3/924* (2013.01); *E05Y 2900/15* (2013.01); *E06B 3/5072* (2013.01)

(56) References Cited

U.S. PATENT DOCUMENTS

| | | | | |
|---|---|---|---|---|
| 5,749,172 | A * | 5/1998 | Isopahkala | E05D 15/0604 49/124 |
| 6,301,833 | B1 * | 10/2001 | Airikkala | E05D 15/58 160/196.1 |
| 6,397,522 | B1 * | 6/2002 | Nussbaum | E05B 53/003 49/127 |
| 6,553,715 | B1 * | 4/2003 | Lonnberg | E05D 15/0608 160/196.1 |
| 7,260,916 | B2 * | 8/2007 | Sarnell | E04B 2/827 160/196.1 |
| 9,470,038 | B2 * | 10/2016 | Ona-Gonzalez | E06B 9/00 |
| 9,487,985 | B2 * | 11/2016 | Conley | E06B 3/924 |
| 2015/0284949 | A1 * | 10/2015 | Hilliaho | E06B 3/924 52/204.1 |

FOREIGN PATENT DOCUMENTS

| | | | |
|---|---|---|---|
| FI | 120946 | B | 5/2010 |
| WO | 2014/068178 | A1 | 5/2014 |

* cited by examiner

LOCKING ARRANGEMENT AND PANEL SYSTEM

OBJECT OF THE SOLUTION

The object of the solution is a panel system. The object of the solution further comprises a panel system locking arrangement.

BACKGROUND OF THE PRESENT SOLUTION

Different types of panel systems may be incorporated in buildings, for example, in conjunction with the balcony or terrace of a building. These are often panels made of glass or a similar material, several panels being positioned most preferably in succession in a panel system. Panel systems may also be provided inside buildings, for example as walls.

A panel system typically comprises an upper guide and a lower guide, which may be rails guiding the travelling of the panel and inside or on top of which are one or more hinge elements and/or a control elements fixed to the panel. The hinge element and/or control element controls the travelling of the panel, or the panel is suspended on the upper guide by means of them, or the panel rests through them on the lower guide which supports the panel. The hinge element or the control element is either stationary or movable along the upper or lower guide with the panel. The panel may be movable along the upper and lower guides by means of the said hinge element or control element. Moving typically takes place manually.

The upper and lower guides are usually horizontal and fixed, for example, to the structures of the building. The lower guide may be positioned on floor level or higher, for example, on a railing. The panel may be opened and closed by using one or more hinge element, by means of which the panel turns around a vertical rotation axis. The said openable panel may in addition comprise one or more control elements, by means of which the panel remains closed, and which is allowed to come out of the upper or lower guide to enable the opening of the panel. The upper or lower guide may comprise an opening through which the control element passes, or the control element may be lifted out, for example from the lower profile.

The hinge element may be configured to lock with the hinge element of the adjacent panel, the upper guide or the lower guide when the panels are open and adjacent to one another. Two or more panels may be open and adjacent to one another in a stack, whereupon a free opening is formed, for example, for airing or access.

A known panel system is disclosed in publication WO-2014068178-A1.

Locking of the panel in place is important to prevent the panel from falling when it is opened. When the panel is opened, the control element leaves from the upper guide and/or lower guide and thus the panel must be supported and kept upright by the hinge element. This is ensured by the hinge element attaching, for example, to the upper guide. The said attachment should be ensured already with as small turning angles of the panel as possible to guarantee that the panel is always supported and safe to use.

A BRIEF SUMMARY OF THE SOLUTION PRESENTED

The panel system according to the solution comprises a lower guide and an upper guide which are essentially parallel, and at least one panel which is movable, vertical in its position of use and located between the lower guide and the upper guide, and connected to the lower guide and the upper guide for moving the panel on the lower guide. The panel system comprises a hinge element which is fixed to the panel, located inside the upper guide and allows opening of the panel by turning around an essentially vertical rotation axis.

The panel system further comprises at least two locking housings located in the upper guide and positioned successively in the longitudinal direction of the upper guide. The locking housings comprise two opposite locking recesses, the shapes of which together define a circle with a radius R3 and between which remains a passage having a width P2. The passage is parallel with the longitudinal direction of the upper guide and the hinge element can travel through the passage from one locking housing to another.

The distance between the locking housings in the direction of the upper guide is distance P1, which is arranged to be less than two times radius R3.

The advantage of the solution presented is that by increasing the size of the locking housings, the spread angle of the panel, at which the hinge element begins to move into the locking recess and allows early locking of the hinge element, can be reduced. At the same time as the distance between the locking housings is allowed to be smaller than the circle defined by them, the opened panels can be brought as close to each other as possible and can thus be stored in as compact a space as possible.

According to one example, the hinge element also comprises two locking cams, which define a radius R1, and a guiding edge remaining between them which rotates around the rotation axis with the hinge element. The shape of the guiding edge defines the circle with radius R2 in such a way that radius R2 is smaller than radius R1, and in addition radius R2 and radius R1 together, and with clearance, equal distance P1. At the same time, radius R2 is smaller than radius R3.

The advantage of this is that it prevents the locking cams of adjacent hinge elements from colliding. A panel locking cam may be configured to collide with the guiding edge of an adjacent panel in order to bring the panel to a stop.

A further advantage is that due to the guiding edge, an open panel may, in the opened position, be turned within a predetermined sector, or alternatively, the open panel may be turned to a certain turning angle towards an adjacent panel.

The panel system locking arrangement according to the solution presented comprises a hinge element intended to be fixed to a panel of the panel system. The hinge element allows the panel to be opened by turning it around the rotation axis. The locking arrangement further comprises at least two locking housings positioned in succession, the locking housings comprising two opposite locking recesses. The shapes of the locking recesses together define a circle with radius R3 and between the recesses remains a passage with width P2, through which the hinge element can pass from one locking housing to another. The distance of the locking housings from one another is distance P1.

According to one example, the hinge element further comprises the locking cams and guiding edge described above. The locking cams and locking recesses are set at essentially the same point, for example on the same level, with respect to the rotation axis. The height of the locking cams corresponds to distance P5 and the height of each locking recess corresponds to distance P4. Distance P4 is configured to be greater than distance P5.

The advantage is that the position of the locking housings in height or with respect to the rotation axis is allowed to change or may be adjusted. Thus, also the position of the locking housings with respect to the panel and the hinge element is allowed to change or may be adjusted.

According to one example, distance P1 is configured to be less than two times radius R3.

DESCRIPTION OF THE DRAWINGS

The solution presented is described in greater detail in the following, with reference to the accompanying drawings.

DETAILED DESCRIPTION OF THE SOLUTION

In the Figures, the same or corresponding parts are marked with the same reference number.

Figure 1:
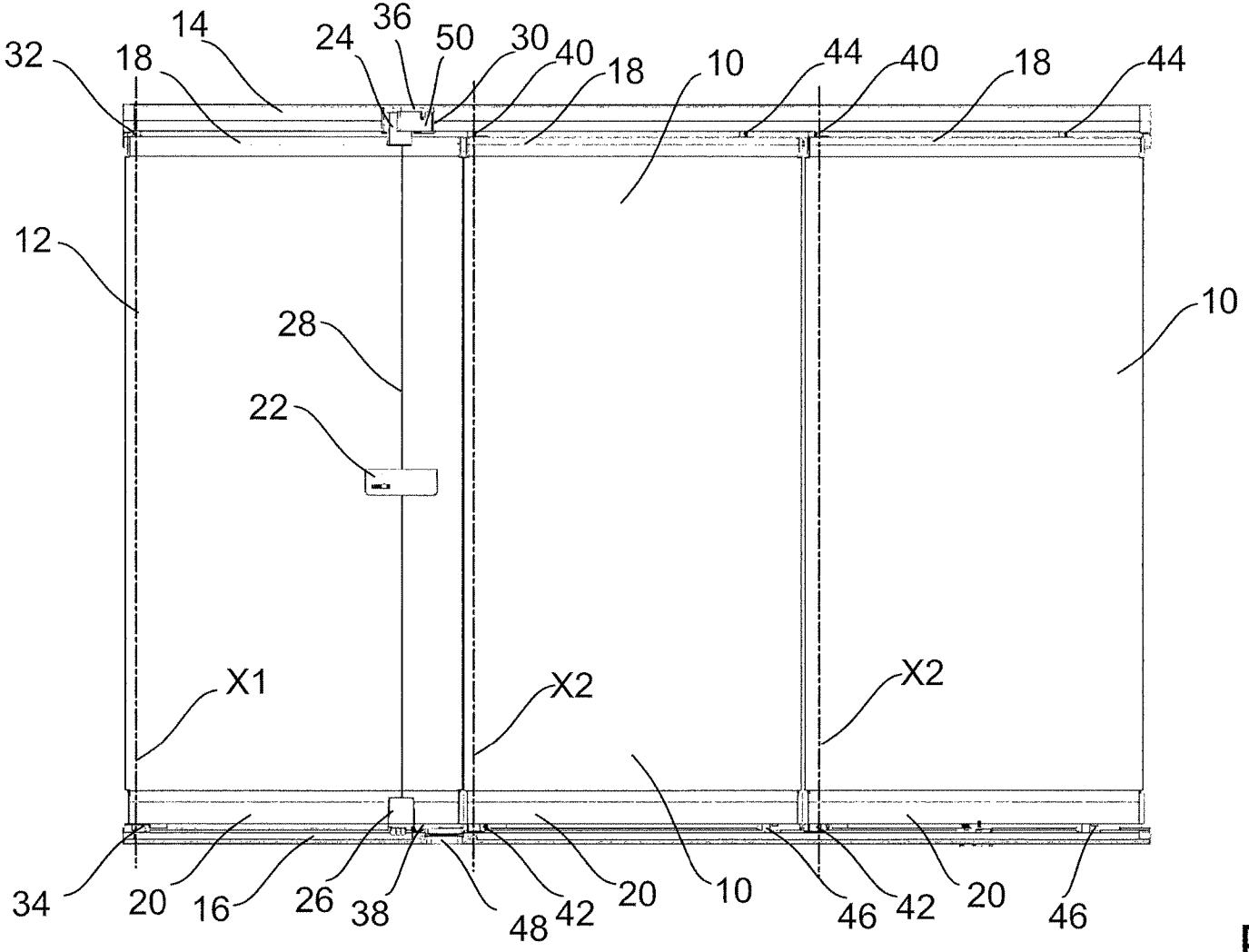
FIG. 1 shows a front view of a panel system to which the solution presented may be applied and which is vertical in its position of use.

FIG. 1 shows an example of a panel system to which the solution presented may be applied. In the position of use shown in the example of FIG. 1, the panel system is vertical.

The panel system may comprise at least one moving panel 10, a lower guide 16, an upper guide 14, a hinge element 40 fixed to the upper edge of each panel 10 and a hinge element 42 fixed to the lower edge of each panel 10.

According to one example, the panel system may further comprise at least one stationary panel 12 which does not move along the lower and upper guides 14, 16, a hinge element 32 fixed to the upper edge of each panel 12 and a hinge element 34 fixed to the lower edge of each panel 12.

The panel 12 may be opened in such a way that it turns around a vertical rotation axis X1. The rotation axis X1 is perpendicular to the longitudinal directions of the lower and upper guides 14, 16. The said rotation axis X1 is furthermore located in the vicinity of one vertical edge of the panel 12.

When closed, the panels 10, 12 are preferably parallel and positioned in succession in such a way that they form a wall or window or an access opening. The lower guide 16 and the upper guide 14, which are parallel, are located at a distance from one another and positioned vertically on top of one another. The panels 10, 12 are located between the lower guide 16 and the upper guide 14 in such a way that the panels 10, 12 are vertical. The two opposite upright edges of the panel 10, 12 are vertical and the upper and lower edges of the panel 10, 12 are horizontal. The lower guide 16 may attach to a railing or a suitable surface, for example the floor. The lower guide 16 may be at least partly embedded in a railing or floor. The upper guide 14 may attach, for example, to a ceiling or other suitable structure.

The hinge element 32 is located inside the upper guide 14 and allows the panel 12 to be opened. Rotation axis X1 passes through the hinge element 32. The hinge element 32 may be locked to the upper guide 14.

The hinge element 34 is located inside the lower guide 16, on top of it, and allows the panel 12 to be opened. Rotation axis X1 also passes through the hinge element 34. The hinge element 34 may be locked to the lower guide 16.

Hinge element 32 and/or hinge element 34 may comprise a shaft journal 60 on which the panel 12 turns. Hinge element 32 and/or hinge element 34 may be configured to lock with the hinge element 40, 42, upper guide 14 or lower guide 16 of the adjacent panel 10 when panel 10 is opened and panel 12 is open.

According to one example and FIG. 1, on the upper edge of the panel 10, 12 may be fixed a lath 18 to which the hinge element 32, 40 can be fixed, for example, with screws or nuts. On the lower edge of the panel 10, 12 may be fixed a lath 20 to which the hinge element 34, 42 can be fixed, for example, with screws or nuts. The lath 19, 20 forms a part of the panel 10, 20, for example, the lower edge or upper edge of the panel 10, 12.

According to one example and FIG. 1, on the upper edge of the panel 12 may be fixed a lock part 24 which attaches to the upper guide 14 and is at a distance from the hinge element 32. The lock part 24 can be opened and detached from the upper guide 14 for opening the panel 12. The lock part 24 is controlled, for example, by means of a pulling cable, chain or wire or the like 28. To the panel 12 may be fixed a handle part 22. The handle part 22 may control the lock part 24, other locking part or other parts of the panel system, for example, by means of the power conveyed by a cable, chain, wire or the like 28. Moving the handle part 22 opens the lock part 24. The handle part 22 is, for example a turning or rotating handle or knob fixed to the centre part of the panel 12 or alternatively on the lower edge of the panel 12, for example on a lath 20. According to one example, the handle part 22 is a part of the above-mentioned locking part or other above-mentioned part of the panel system.

According to one example and FIG. 1, on the lower edge of the panel 12 may be fixed a lock part 26 which attaches to the lower guide 16 and is at a distance from the hinge element 34. The lock part 26 is controlled, for example, by means of a handle and a pulling cable, chain, wire or the like 28.

The moving panel 10 may be moved along the lower and upper guides 14, 16. The panel 10 may, in addition, be opened in such a way that it turns around a vertical rotation axis X2. For opening, the panel 10 may be moved to a predetermined point where, for example, rotation axes X1 and X2, or two rotation axes X2, are close to one another. Rotation axis X2 is perpendicular to the longitudinal directions of the lower and upper guides 14, 16. The said rotation axis X2 is furthermore located in the vicinity of one vertical edge of the panel 10.

The hinge element 40 is located inside the upper guide 14 and allows the panel 10 to be opened. Rotation axis X2 passes through the hinge element 40. The hinge element 40 is able to move along the upper guide 14.

The hinge element 42 is located inside the lower guide 16, on top of it, and allows the panel 10 to be opened. Rotation axis X2 also passes through the hinge element 42. The hinge element 42 is able to move along the lower guide 16, for example by means of a roller or wheel.

Hinge element 40 and/or hinge element 42 may comprise a shaft journal 60 on which the panel 10 turns. Hinge element 40 and/or hinge element 42 may be configured to lock with the upper guide 14, the lower guide 16 or the hinge element 40, 42 of the adjacent panel 10 when the adjacent panel 10 is opened and panel 10 is open.

The panel 10 may in addition comprise a control element 44 attached on the upper edge of the panel, for example, to a lath 18. The control element 44 is located inside the upper guide 14, able to move along the upper guide 14, and at a distance from the hinge element 40. While inside the upper guide 14, the control element 44 keeps the panel 10 closed. The upper guide 14 may comprise an opening 30 allowing the control element 44 to exit from the upper guide 14 and to detach from the upper guide 14 in order to make the opening the panel 10 possible. The opening 30 may be situated under the lock part 24. By the opening 30 may be located an upper control unit 50 which supports the control element 44 exiting from and returning to the upper guide 14.

The panel 10 may comprise a control element 46 fixed to the lower edge of the panel, for example to a lath 20. The control element 46 is located inside the lower guide 16, or on top of it, so as to allow the control element 46 to move along the lower guide 16. The control element 46 is at a distance from the hinge element 42. The control element 46 moves along the lower guide 16, for example, by means of a roller or wheel. The control element 46 is allowed to detach or distance itself from the lower guide 16, thus enabling the opening of the panel 10.

The lower guide 16 may comprise a support part 48. A support part 48 fixed in place adjacent to the lower guide 16 supports an opening panel 10 which has been moved to a predetermined point for opening the panel 10. The support part 48 is then at a distance from the hinge element 42 of the opening panel 10.

Figure 2:
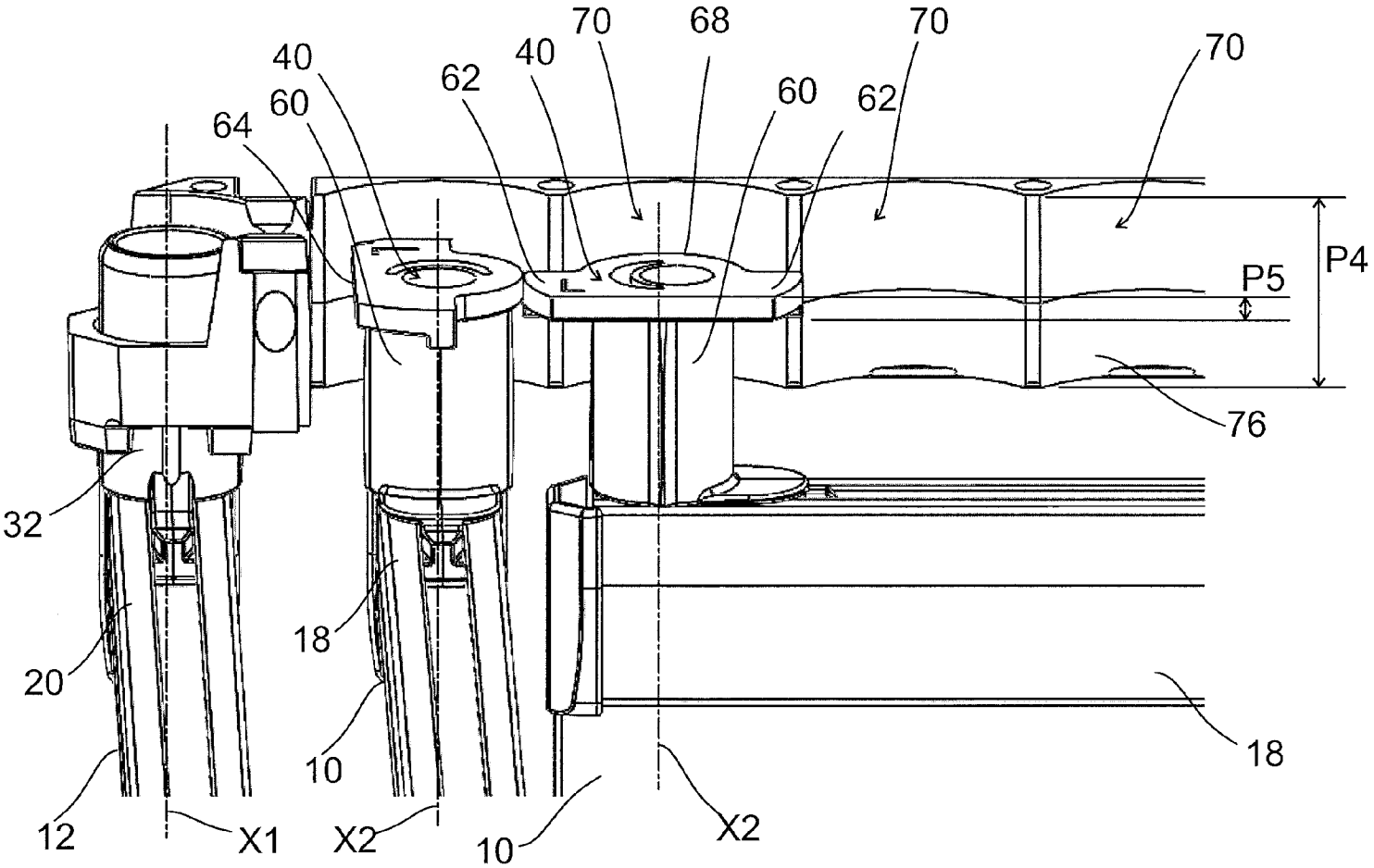
FIG. 2 shows a side view of an example of the panel system of FIG. 1, a hinge element and a panel, to which the solution presented may be applied when a moving panel is open and the adjacent panel is closed.
Figure 3:
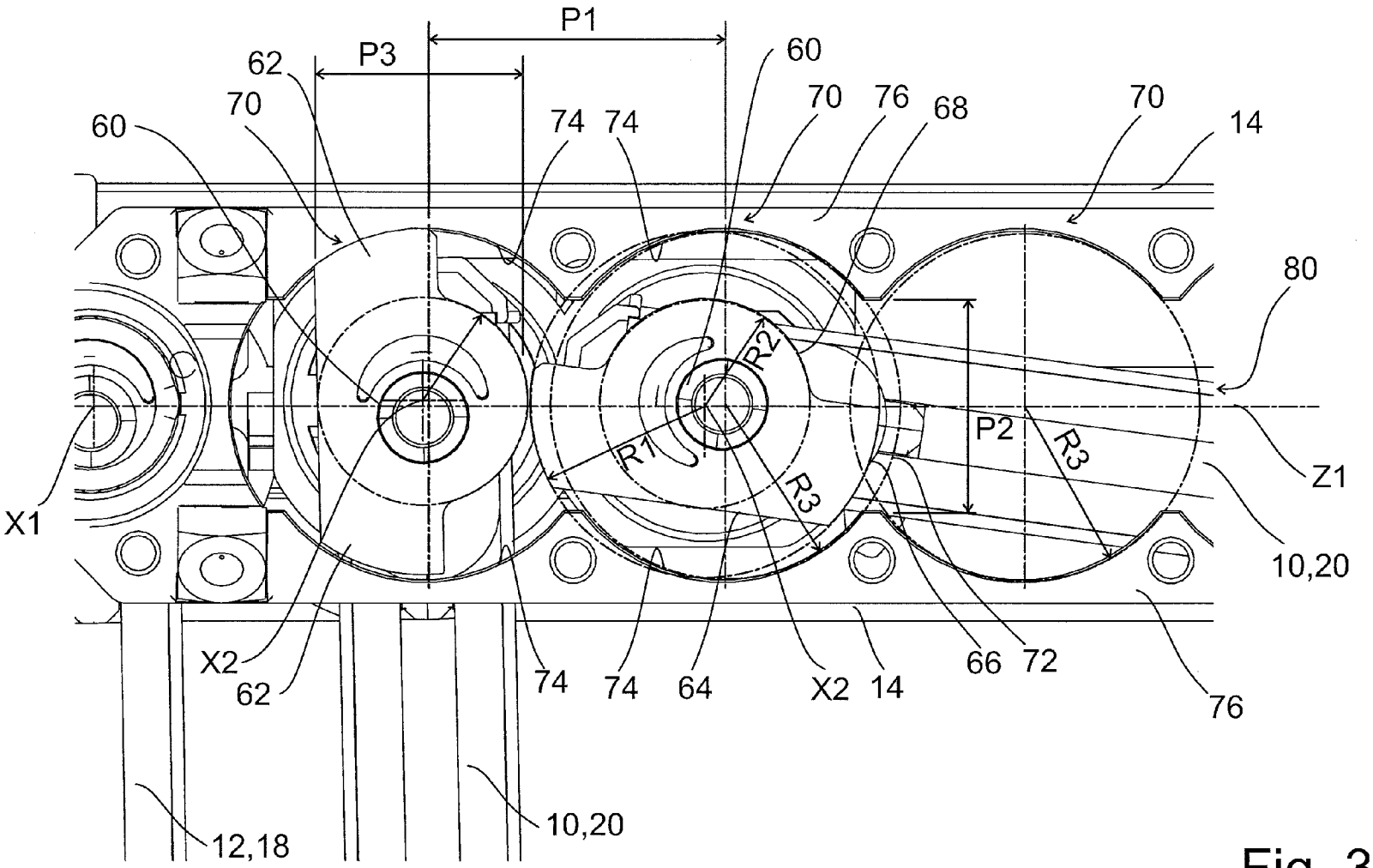
FIG. 3 shows a top view of the example of FIG. 2, a locking housing, a hinge element and a panel when the moving panel is open and the adjacent panel is about to open or close.

The hinge element 40 of the panel 10 moving according to the solution presented and FIGS. 2 and 3 may comprise a shaft journal 60 which is attached, on the one hand, by its lower end to the panel 10, for example, by means of a lath 18, and on the other hand, positioned by its upper end inside the upper guide 14. For the sake of clarity, the upper guide 14 is omitted in FIG. 2 and cut open at the top in FIG. 3 as well as in FIGS. 4 and 5.

The hinge element 40 is attached to the panel 10 rigidly so that, for example, the shaft journal 60 and the structures formed in it turn around rotation axis X2 together with the panel 10 when the panel 10 is opened.

At the upper end of the hinge element 40, for example, at the end of the shaft journal 60, are two locking cams 62 extending in opposite directions which rotate with the hinge element 40.

The locking cams 62 are configured to extend parallel with the upper guide 14 and its longitudinal direction when the panel 10 is in a closed position and parallel with the upper guide 14. The locking cams 62 are directed in opposite directions, diagonally or transversely with respect to the upper guide 14, when the panel 10 is in the open position, for example, turned by 90° with respect to the upper guide 14 in accordance with FIG. 3 or FIG. 4.

The shape of the end surface 66 of each locking cam 62 follows the shape of the circumference of a circle having a radius R1 and a midpoint located on rotation axis X2 and a circular disc perpendicular to rotation axis X2. Each locking cam 62 is configured so that the end surface 66 covers a predetermined part of the circumference of a circle with radius R1, preferably an equal part. The perpendicular distance of the end surface 66 from rotation axis X2 thus corresponds at most to radius R1.

Figure 4:
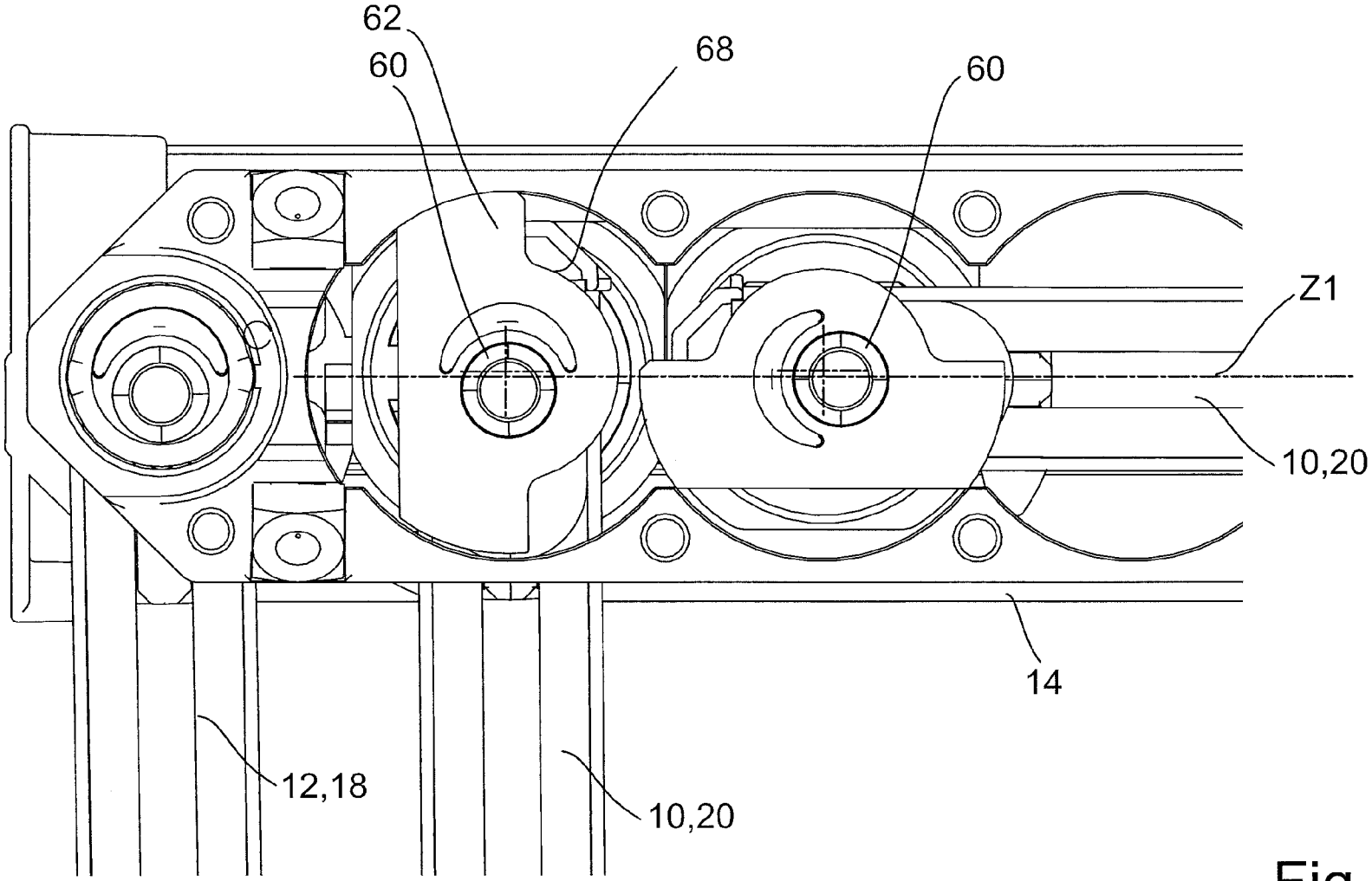
FIG. 4 shows a top view of the example of FIG. 2, a locking housing, a hinge element and a panel when the moving panel is open and the adjacent panel is closed.

The hinge element 40 comprises a tapered section 64 located between two locking cams 62. The tapered section 64 covers a predetermined part of the circumference of the circle with radius R1. The tapered section 64 may cover, on one side of the hinge element 40, the section of the circumference of the circle with radius R1 remaining between the locking cams 62 almost completely. The shape of the tapered section 64 is preferably essentially straight and extends parallel with the upper guide 14 and its longitudinal direction when the panel 10 is in a closed position and parallel with the upper guide 14, as shown in FIG. 4. The shape of the tapered section 64 extends diagonally or transversely with respect to the upper guide 14, when the panel 10 is in the open position, for example, turned by 90° with respect to the upper guide 14, as shown in FIG. 3 or FIG. 4.

Figure 5:
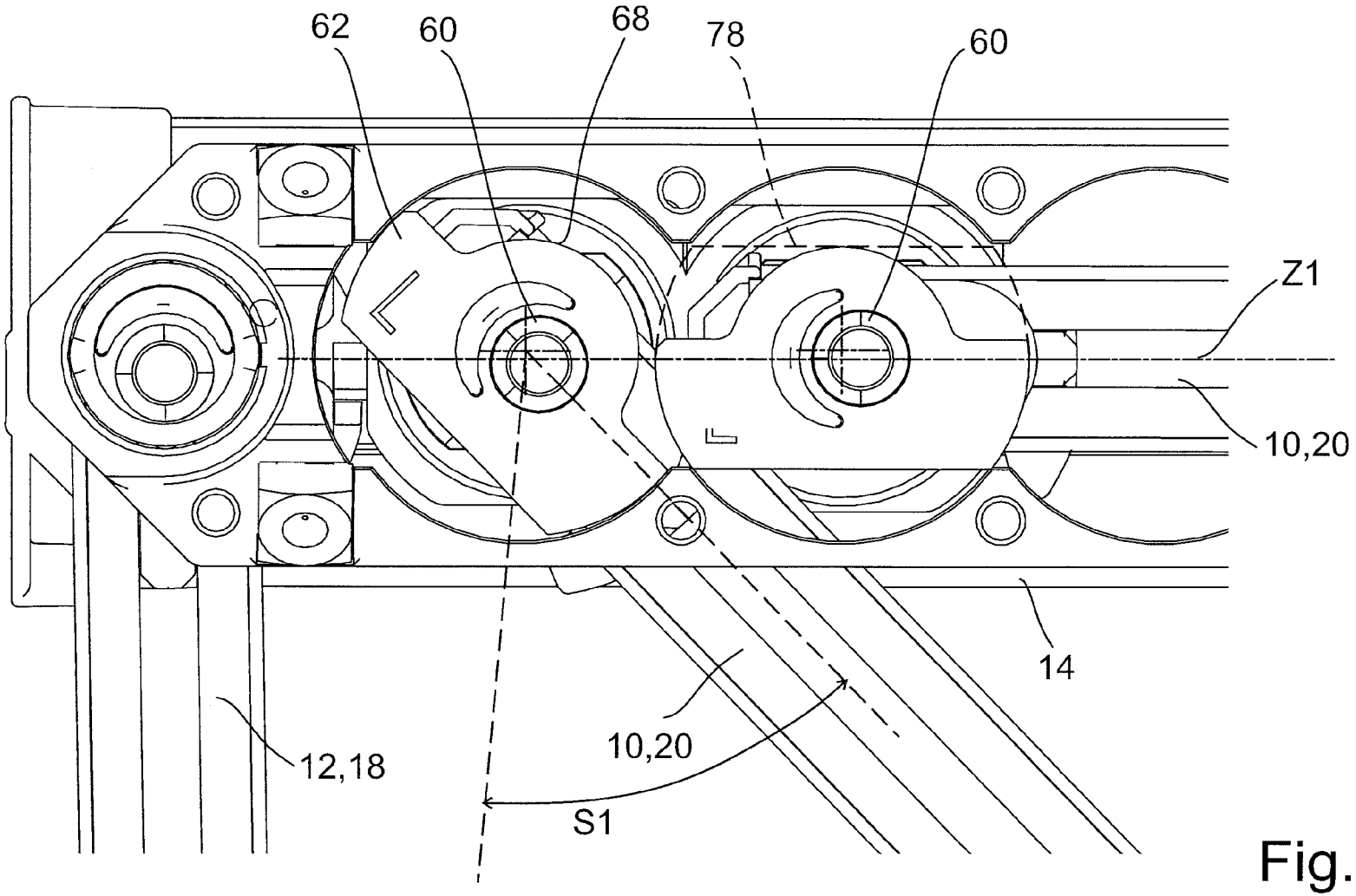
FIG. 5 shows a top view of the example of FIG. 2, a locking housing, a hinge element and a panel when the moving panel is turned and the adjacent panel is closed.

According to one example and FIG. 5, the hinge element 40 comprises a corresponding opposite tapered section 78 located between two locking cams 62 and on opposite side of the hinge element 40 with respect to the rotation axis X2. The shape of the opposite tapered section 78 is most preferably essentially straight and parallel with the shape of tapered section 64. The perpendicular distance between tapered section 64 and the opposite tapered section 78 equals at most distance P3. The shape of the said opposite tapered section 78 is sketched with a broken line in the Figure.

According to one example and FIG. 3, the hinge element 40 may also comprise a guiding edge 68 located between two locking cams 62. With respect to the tapered section 64, the guiding edge 68 is located on opposite side of the hinge element 40 and the rotation axis X2.

According to the first example and FIG. 3, the shape of the guiding edge 68 follows the shape of the circumference of a circle having a radius R2 and a midpoint located on rotation axis X2 and a circular disc perpendicular to rotation axis X2. The guiding edge 68 covers a predetermined part of the circumference of a circle having a radius R2. The guiding edge 68 may cover almost completely the section of the circumference of the circle with a radius R2 remaining between two locking cams 62. According to another example, the shape of the guiding edge 68 remains inside the above-mentioned circle having a radius R2. According to above-mentioned examples, the perpendicular distance of the guiding edge 68 from rotation axis X2 thus corresponds at most to radius R2.

Radius R2 is configured to be smaller than radius R1. The distance between the tapered section 64 and the guiding edge 68, perpendicular with respect to the tapered section 64, equals at most distance P3.

The upper guide 14 comprises two or more successive identical locking housings 70. The locking housings 70 are located successively parallel to the upper guide 14. The hinge element 40 of the panel 10 is located at the locking housing 70 when the panel 10 is at a predetermined point for opening. Each locking housing 70 comprises locking recesses 74 located on opposite sides of the hinge element 40.

Several successive locking recesses 74 may be configured in the same locking recess part 76 fixed to the upper guide 14. Opposite locking recesses 74 may be configured in the same locking recess part 76 which is fixed to the upper guide 14 and through which the hinge element 40 can pass from one locking housing 70 to another.

The shapes of the two opposite locking recesses 74 of each locking housing 70 follow the shape of the circumference of a circle having a radius R3, a midpoint located in the centre of the locking housing 70 and a circular disc at the same time perpendicular to rotation axis X2. Each locking recess 74 covers a predetermined part of the circumference of the circle with radius R3.

From one locking housing 70 to another runs a passage 80 which is located between opposite locking recesses 74, is parallel with the upper guide 14, and through which the hinge element 40 can pass into one locking housing 70, for example, the outermost locking housing 70 of the locking recess part 76, and from there further to other locking housings 70. The width of the said passage 80 in the perpendicular direction with respect to the longitudinal direction of the upper guide 14 is width P2. The hinge element 40 is stopped in a predetermined locking housing 70 to which the panel 10 locks for the purpose of opening.

The midpoints of circles having radii R3 in successive locking housings 70 are most preferably located on the same essentially straight line Z1 which is parallel with the upper guide 14 and its longitudinal direction. Rotation axis X2 follows line Z1 or runs parallel with line Z1 when the hinge element 40 of the panel 10 moves along the upper guide 14 from one locking housing 70 to another.

Radius R3 is configured to be smaller than radius R1 by a clearance. Width P2 is configured to be smaller than two times radius R1. Width P2 is configured to be greater than two times radius R2 increased by a clearance. Width P3 is at most equal or is less than width P2. According to one example, width P3 increased by a clearance may correspond to width P2.

When the panel 10 moves and is parallel with the upper guide 14 as shown in FIG. 4 or FIG. 5, the tapered section 64 faces the locking recess 74 and the locking cams 62 are directed in opposite directions parallel with line Z1. The tapered section 64 is most preferably located on the side of the upper guide 14 and line Z1 towards which the panel 10 turns when it opens, as shown in FIG. 3. One of the locking cams 62 then comes into contact with a locking recess 74 already following a slight turn of the panel 10. The said locking recess 74 is on the same side of line Z1 as the said tapered section 64.

When the stopped panel 10 is opened, the locking cams 62 turn inside the locking housing 70 and extend in opposite directions diagonally or perpendicularly to line Z1. The turning, opening panel 10 is supported through one locking cam 62 first in at least one locking recess 74 which locking cam 62 prevents the panel 10 from falling over or swaying. In the example of FIG. 3, when the said panel 10 is opened further, the panel 10 is supported through the opposite locking cam 62 in the opposite locking recess 74. The locking cams 62 of the opened panel 10 are prevented from moving out of the locking housing due to the ratio of width P2 to radius R1 described above.

The guiding edge 68 of the turned opened panel 10 faces one locking cam 62 of the adjacent moving closed panel 10, as shown in FIG. 4 and FIG. 5.

According to one example and FIG. 3, the locking cam 62 of a moving panel 10 is configured to collide with the guiding edge 68 of the adjacent panel 10 and to stop the panel 10 so that the hinge element 40 will settle in the locking housing 70.

When the guiding edge 68 follows the circumference of a circle with radius R2, the opened panel 10 may, in the opened position, be turned within a predetermined sector S1, as shown in FIG. 5, or towards the adjacent panel 10 to a specific turning angle. The midpoint of sector S1 is on rotation axis X2. Despite the turned position of the opened panel 10, the hinge element 40 of the adjacent panel 10 may settle in the locking housing 70, for example, stopped by the guiding edge 68. At the same time, a collision of the locking cams 62 of adjacent hinge element 40 with one another is prevented.

The said sector S1 extends transversely with respect to the longitudinal direction of the upper guide 14 or line Z1. The minimum angle and maximum angle of sector S1 with respect to line Z1, or correspondingly the minimum turning angle of an opened panel 10 with respect to line Z1, correspond to the opening angles of the panel 10 with respect to the longitudinal direction of the upper guide 14. The said minimum angle, maximum angle and turning angle depend on the extent of the shape of the guiding edge 68 and of the end surface 66 of the locking cam 62.

The distance P1 between the midpoints of two successive locking housings 70 corresponds to the distance between adjacent locking housings 70 in the direction of the upper guide 14 and line Z1. Distance P1 is configured to be smaller than two times radius R3. Distance P1 is configured to be smaller than two times radius R1. In addition to this, radius R1 and radius R2 combined and increased with a clearance correspond to distance P1, in other words radius R1 and radius R2 combined is less than distance P1.

According to one example, distance P1 is configured to be 15-20% less than two times radius R3 or two times radius R1. According to one example, radius R2 is at most ⅔ of radius R1 or less.

According to one example and FIG. 2, the locking cams 62, guiding edge 68 and locking recesses 74 settle essentially at the same height with respect to rotation axis X2, which is vertical in its position of use. The locking cams 62 and the guiding surface 68 may be equally high. The height of the end surfaces 66 of the locking cams 62 equals distance P5. The height of the locking recess 74 equals distance P4. Distance P4 is configured to be greater than distance P5. It is, in addition, most preferable that distance P4 is at least five times, or at least seven times, distance P5. Due to this, the position of the upper guide 14 and the locking housings 70 in elevation with respect to the panel 10 and the hinge element 40 is allowed to change or may be adjusted.

The upper guide 14 and/or the lower guide 16, or lath 18 and/or lath 20 are, according to one example, made of aluminium or an aluminium alloy, and have a continuous or elongated in shape. It is also possible to use other materials and metals.

The hinge element 32, 34, 40, 42 or the control element 36, 38, 44, 46 or the locking recess part 76 is most preferably a piece made of plastic material but other materials, such as metal, may also be used.

According to one example, the panel 10, 12 is made of tempered glass. It is also possible to use other glass materials and sheet-like materials. The panel 10, 12 is preferably transparent, but opaque panels can also be used.

The solution presented is not limited only to the alternatives and examples shown in the accompanying Figures or specifically disclosed in the foregoing description, or to which reference has been made in the description. The features disclosed in the foregoing may be combined and implemented in various combinations.

The different embodiments of the solution are disclosed in the accompanying claims.

The invention claimed is:

1. A panel system, wherein the panel system comprises:

a lower guide and an upper guide which are essentially parallel;

at least one panel, which is movable and located between the lower guide and the upper guide and connected to the lower guide and the upper guide for moving the panel on the lower guide;

a hinge element which is fixed to the panel, located inside the upper guide and allows opening the panel to be opened by turning the panel around a rotation axis;

at least two locking housings which are in the upper guide and located successively in a longitudinal direction of the upper guide, each of the locking housings comprising two opposite locking recesses, the shapes of which together define a circle with a radius R3, and between which remains a passage having a width P2, the passage being parallel with the longitudinal direction of the upper guide and through which the hinge element can travel from one locking housing to another, wherein a distance between midpoints of the locking housings from one another in the longitudinal direction of the upper guide is a distance P1, which is configured to be less than two times the radius R3, wherein the hinge element comprises two locking cams extending in opposite directions, the locking cams rotating with the hinge element around the rotation axis and being configured to extend parallel with the upper guide when the panel is parallel with the upper guide, the locking cams comprising end surfaces, the shapes of the end surfaces defining a circle with a radius R1, the radius R1 corresponding to the radius R3, and the width P2 being less than two times the radius R1, and wherein the hinge element comprises a guiding edge remaining between the two locking cams, the guiding edge rotating with the hinge element around the rotation axis and the shape of the guiding edge defining a circle with a radius R2 such that the radius R2 is less than the radius R1, and the radius R2 and the radius R1 together are less than the distance P1.

2. The panel system as claimed in claim 1, wherein on the upper edge of the panel is fixed a lath by means of which the hinge element is fixed to the panel.

3. The panel system as claimed in claim 1, wherein the hinge element further comprises a tapered section which is located between the two locking cams, on the opposite side of the rotation axis with respect to the guiding edge, and the shape of the tapered section extending parallel with the longitudinal direction of the upper guide when the panel is parallel with the upper guide and, in addition, the perpendicular distance between the guiding edge and the tapered section corresponds at most to the width P2.

4. The panel system as claimed in claim 3, wherein the locking cams, guiding edge and locking recesses settle at essentially the same height with respect to the rotation axis, and wherein the height of the locking cams corresponds to a distance P5 and the height of each locking recess corresponds to a distance P4, which is greater than the distance P5.

5. The panel system as claimed in claim 4, wherein the distance P4 is at least five times greater than the distance P5.

6. The panel system as claimed in claim 1, wherein the radius R2 is at most two thirds of the radius R1 or less.

7. The panel system as claimed in claim 1, wherein the distance P1 is 15% to 20% less than two times the radius R3.

8. A panel system locking arrangement comprising:

a lower guide and an upper guide which are essentially parallel;

at least one panel, which is movable and located between the lower guide and the upper guide and connected to the lower guide and the upper guide for moving the panel on the lower guide;

a hinge element which is fixed to the panel, and is located inside the upper guide, and allows the panel to be opened by turning the panel around a rotation axis;

at least two locking housings which are in the upper guide and located successively in a longitudinal direction of the upper guide, each of the locking housings comprising two opposite locking recesses, the shapes of which together define a circle with a radius R3 and between which remains a passage having a width P2, the passage being parallel with the longitudinal direction of the upper guide and through which the hinge element can travel from one locking housing to another, wherein a distance between midpoints of the locking housings from one another in the longitudinal direction of the upper guide is a distance P1, wherein the hinge element comprises two locking cams extending in opposite directions, the locking cams rotating with the hinge element around the rotation axis and being configured to extend parallel with the upper guide when the panel is parallel with the upper guide, the locking cams comprising end surfaces, the shapes of the end surfaces defining a circle with a radius R1, the radius R1 corresponding to the radius R3, and the width P2 being less than two times the radius R1, wherein the locking cams and locking recesses settle at essentially the same height with respect to the rotation axis, and wherein a height of the locking cams corresponds to a distance P5 and a height of each locking recess corresponds to a distance P4, which is greater than the distance P5.

9. The panel system locking arrangement as claimed in claim 8, wherein the distance P1 is configured to be less than two times the radius R3.

10. The panel system locking arrangement as claimed in claim 9, wherein the hinge element comprises a guiding edge remaining between the two locking cams, the guiding edge rotating with the hinge element around the rotation axis and the shape of the guiding edge defining a circle with a radius R2 in such a way that the radius R2 is less than the radius R1, and in addition the radius R2 and radius R1 together are less than the distance P1.

11. The panel system locking arrangement as claimed in claim 10, wherein the radius R2 is at most two thirds of the radius R1 or less.

12. The panel system locking arrangement as claimed in claim 10, wherein the distance P1 is 15% to 20% less than two times the radius R3.

13. The panel system locking arrangement as claimed in claim 8, wherein the distance P4 is at least five times greater than the distance P5.

* * * * *